US012806678B2

(12) United States Patent
Miyake

(10) Patent No.: US 12,806,678 B2
(45) Date of Patent: Nov. 24, 2026

(54) PRESS LINE, PRESS FORMING CONDITION CALCULATION METHOD, AND PRESS FORMING CONDITION CALCULATION PROGRAM

(71) Applicant: JFE Steel Corporation, Tokyo (JP)

(72) Inventor: Hiroto Miyake, Tokyo (JP)

(73) Assignee: JFE Steel Corporation, Tokyo (JP)

( * ) Notice: Subject to any disclaimer, the term of this patent is extended or adjusted under 35 U.S.C. 154(b) by 463 days.

(21) Appl. No.: 18/279,976

(22) PCT Filed: Mar. 3, 2022

(86) PCT No.: PCT/JP2022/009139
§ 371 (c)(1),
(2) Date: Sep. 1, 2023

(87) PCT Pub. No.: WO2022/186337
PCT Pub. Date: Sep. 9, 2022

(65) Prior Publication Data

US 2024/0307944 A1 Sep. 19, 2024

(30) Foreign Application Priority Data

Mar. 4, 2021 (JP) ..... 2021-034161
Mar. 4, 2021 (JP) ..... 2021-034162
(Continued)

(51) Int. Cl.
*B21D 24/00* (2006.01)
*B21D 28/02* (2006.01)
*B21D 43/02* (2006.01)

(52) U.S. Cl.
CPC ..... *B21D 24/005* (2013.01); *B21D 28/02* (2013.01); *B21D 43/021* (2013.01)

(58) Field of Classification Search
None
See application file for complete search history.

(56) References Cited

U.S. PATENT DOCUMENTS 5,059,903 A 10/1991 Otaka et al.
5,134,368 A 7/1992 Otaka et al.
(Continued)

FOREIGN PATENT DOCUMENTS

CN 1878623 A 12/2006
EP 1688196 A1 8/2006
(Continued)

OTHER PUBLICATIONS

Office Action (Notice of Reasons for Refusal) issued Jan. 30, 2024, by the Japan Patent Office in corresponding Japanese Patent Application No. 2023-503946 and an English translation of the Office Action and Concise Statement of Relevance of Office Action. (7 pages).

(Continued)

*Primary Examiner* — Ryan A Jarrett
(74) *Attorney, Agent, or Firm* — Buchanan Ingersoll & Rooney PC

(57) ABSTRACT

A press line includes: a first press machine configured to shear an outer peripheral portion of a metal material by using a blanking die; a second press machine configured to form a press-formed component by performing press forming on the sheared metal material with a forming die; a preprocessing device configured to perform predetermined preprocessing on the metal material; a measurement instrument configured to measure information on a material characteristic value of the metal material before the press forming; and a control device configured to calculate a press forming condition for inhibiting occurrence of a forming defect for a metal material to be formed by inputting the material characteristic value of the metal material to be formed and manufacturing information to a machine learning model.

3 Claims, 9 Drawing Sheets

(30) Foreign Application Priority Data

| | | |
|---|---|---|
| Mar. 4, 2021 | (JP) | 2021-034439 |
| Mar. 4, 2021 | (JP) | 2021-034440 |
| Mar. 4, 2021 | (JP) | 2021-034441 |

(56) References Cited

U.S. PATENT DOCUMENTS

| | | | | |
|---|---|---|---|---|
| 5,414,356 | A | 5/1995 | Yoshimura et al. | |
| 5,692,405 | A | 12/1997 | Kirii | |
| 8,020,418 | B2 | 9/2011 | Suzuki et al. | |
| 8,965,554 | B2 | 2/2015 | Suzuki et al. | |
| 2007/0240470 | A1 | 10/2007 | Suzuki et al. | |
| 2008/0092620 | A1 | 4/2008 | Suzuki et al. | |
| 2011/0094279 | A1* | 4/2011 | Suzuki | B21D 24/10 72/17.3 |
| 2011/0166685 | A1 | 7/2011 | Suzuki et al. | |
| 2020/0094303 | A1 | 3/2020 | Smith et al. | |

FOREIGN PATENT DOCUMENTS

| | | | |
|---|---|---|---|
| JP | S64-078160 | A | 3/1989 |
| JP | 07266100 | A | 10/1995 |
| JP | 2006075884 | A | 3/2006 |
| JP | 2008173686 | A | 7/2008 |
| JP | 5000694 | B2 | 8/2012 |
| JP | 2019126823 | A | 8/2019 |
| JP | 2020-163429 | A | 10/2020 |
| WO | 2020111061 | A1 | 6/2020 |

OTHER PUBLICATIONS

Office Action (Request for the Submission of an Opinion) issued Jul. 31, 2025, by the Korean Intellectual Property Office in corresponding Korean Patent Application No. 10-2023-7029894 and an English translation with the Concise Statement of Relevance of the Office Action. (44 pages).

The Extended European Search Report issued Jul. 1, 2024, by the European Patent Office in corresponding European Patent Application No. 22 763 389.8-1201. (14 of pages).

Office Action (The First Office Action) issued Jan. 17, 2026, by the State Intellectual Property Office of People's Republic of China in corresponding Chinese Patent Application No. 202280018559.X and an English translation with Concise Statement of Relevance of the Office Action. (48 pages).

International Search Report and Written Opinion for International Application No. PCT/JP2022/009139, dated May 17, 2022, 11 pages.

Office Action (Communication pursuant to Article 94(3) EPC) issued May 26, 2026, by the European Patent Office in corresponding European Patent Application No. 22 763 389.8-1201. (9 pages).

Liang et al., "Chongya Muju Sheji Shili Jiaocheng (Tutorial on Stamping-Die Design with Practical Examples)", 1st Edition, (Jun. 30, 2016), vol. 1, pp. 29 and an English translation. (5 pages).

Office Action (Decision of Rejection) issued Aug. 28, 2026, by the State Intellectual Property Office of People's Republic of China in corresponding Chinese Patent Application No. 202280018559.X and an English machine translation with Concise Statement of Relevance of the Office Action. (60 pages).

* cited by examiner

PRESS LINE, PRESS FORMING CONDITION CALCULATION METHOD, AND PRESS FORMING CONDITION CALCULATION PROGRAM

CROSS REFERENCE TO RELATED APPLICATIONS

This is the U.S. National Phase application of PCT/JP2022/009139, filed Mar. 3, 2022, which claims priority to Japanese Patent Application No. 2021-034161, filed Mar. 4, 2021, Japanese Patent Application No. 2021-034162, filed Mar. 4, 2021, Japanese Patent Application No. 2021-034439, filed Mar. 4, 2021, Japanese Patent Application No. 2021-034440, filed Mar. 4, 2021, and Japanese Patent Application No. 2021-034441, filed Mar. 4, 2021, the disclosures of these applications being incorporated herein by reference in their entireties for all purposes.

FIELD OF THE INVENTION

The present invention relates to a press line that manufactures a press-formed component, a press forming condition calculation method, and a press forming condition calculation program.

BACKGROUND OF THE INVENTION

In general, vehicle body components of automobiles are manufactured by press forming with low cost and high productivity. The press forming is performed by pressing a material such as a thin steel sheet with a die installed in a press machine. When mass production press forming is actually performed to manufacture vehicle body components, materials, die shapes, methods, press forming conditions, and the like are preliminarily checked by a computer aided engineering (CAE) technique and component trial production in order to prevent occurrence of a forming defect such as cracking, a wrinkle, surface strain, and a dimensional accuracy defect. It is, however, extremely difficult to manufacture vehicle body components of the same quality at all times in the mass production press forming. For example, even if mechanical characteristics and the like of a thin steel sheet fall within standards specified by an automobile manufacturer, characteristics of tensile strength, elongation, and the like may fluctuate within the range of the standards depending on manufacturing conditions such as components, a rolling condition, and a heat treatment temperature of the thin steel sheet. In particular, in ultra-high tensile steel sheets that have been increasingly applied in recent years, the fluctuation range of the characteristics tends to increase.

In contrast, an increasing number of times of use of a die in mass production press forming cause abrasion and peeling of coating on the surface of the die from the state where the die was a new product manufactured by a die manufacturer. Furthermore, when a galvanized steel sheet or the like is used as a material, a zinc coating on the surface of the material peels off and adheres to the die, which gradually changes characteristics of sliding between the die and the material, such as a friction coefficient. Moreover, when heat generated by processing a material during press forming is transmitted to the die, steel material for the die stores heat and thermally expands. Therefore, a press forming condition is changed by a slight change in the shape of the die. Note that such a factor of fluctuation in quality of a vehicle body component is one example, and the material, the die, and the press forming condition have a plurality of fluctuation factors in the mass production press forming. Therefore, if a series of production conditions that cause an adverse influence are satisfied, forming defects sporadically occur.

In consideration of such a background, Patent Literature 1 and Patent Literature 2 propose methods of inhibiting occurrence of a forming defect in mass production press forming. Specifically, Patent Literature 1 describes a method of controlling a press forming condition based on a characteristic value of a material to be subjected to press forming and a state quantity during the press forming. Furthermore, Patent Literature 2 describes a method of controlling the press forming condition based on the difference between a component shape after press forming and a normal component shape.

PATENT LITERATURE

Patent Literature 1: Japanese Patent No. 5000694
Patent Literature 2: WO 2020/111061

SUMMARY OF THE INVENTION

In the method described in Patent Literature 1, however, information on a forming result indicating whether or not a forming defect has occurred in a component manufactured under the controlled press forming condition is not considered. Therefore, even if a characteristic value and a state quantity used for control are within the ranges of standard values, when a forming defect occurs due to a characteristic value and a state quantity not used for the control, mass production stability may fail to be secured. In contrast, since a control target of the method described in Patent Literature 2 is only an initial position of a movable die, there is no means for securing the dimensional accuracy of a formed component in press forming using a press machine having no movable die. Moreover, it is necessary to preliminarily determine the correlation between the shape of the formed component and the initial position of the movable die for each movable die, which requires much labor and cost.

Aspects of the present invention have been made in view of the above-described problems, and an object thereof is to provide a press line capable of inhibiting occurrence of a forming defect without requiring much labor and cost. Furthermore, another object according to aspects of the present invention is to provide a press forming condition calculation method and a press forming condition calculation program capable of calculating a press forming condition for inhibiting the occurrence of a forming defect. Furthermore, another object according to aspects of the present invention is to provide a press line capable of inhibiting occurrence of cracking of a metal material without requiring much labor and cost. Furthermore, another object according to aspects of the present invention is to provide a press forming condition calculation method and a press forming condition calculation program capable of calculating a press forming condition for inhibiting the occurrence of cracking of a metal material. Furthermore, another object according to aspects of the present invention is to provide a press line capable of inhibiting occurrence of a wrinkle of a metal material without requiring much labor and cost. Furthermore, another object according to aspects of the present invention is to provide a press forming condition calculation method and a press forming condition calculation program capable of calculating a press forming condition for inhibiting the occurrence of a wrinkle of a metal material. Furthermore, another object according to aspects of the present invention is to provide a press line capable of inhibiting occurrence of a dimensional accuracy defect of a press-formed component without requiring much labor and cost. Furthermore, another object according to aspects of the present invention is to provide a press forming condition calculation method and a press forming condition calculation program capable of calculating a press forming condition for inhibiting the occurrence of a dimensional accuracy defect of a press-formed component. Furthermore, another object according to aspects of the present invention is to provide a press line capable of inhibiting occurrence of die damage and a surface quality defect of a press-formed component caused by the die damage without requiring much labor and cost. Furthermore, another object according to aspects of the present invention is to provide a press forming condition calculation method and a press forming condition calculation program capable of calculating a press forming condition for inhibiting the occurrence of the die damage and the surface quality defect of a press-formed component caused by the die damage.

A press line according to a first aspect of the present invention includes: a first press machine configured to shear an outer peripheral portion of a metal material by using a blanking die; a second press machine configured to form a press-formed component by performing press forming on the metal material sheared by the first press machine with a forming die; a preprocessing device provided on a downstream side of the first press machine and configured to perform predetermined preprocessing on the metal material; a measurement instrument configured to measure information on a material characteristic value of the metal material before the press forming; and a control device configured to calculate a press forming condition for inhibiting occurrence of a forming defect for a metal material to be formed by inputting the material characteristic value of the metal material to be formed measured by the measurement instrument and manufacturing information to a machine learning model that uses, as input, the material characteristic value of the metal material and the manufacturing information and uses, as output, a press forming condition of the metal material for inhibiting the occurrence of a forming defect, and perform feedforward control on at least one of the second press machine and the preprocessing device under the calculated press forming condition.

A press line according to a second aspect of the present invention includes: a first press machine configured to shear an outer peripheral portion of a metal material by using a blanking die; a second press machine configured to form a press-formed component by performing press forming on the metal material sheared by the first press machine with a forming die; a preprocessing device provided on a downstream side of the first press machine and configured to perform predetermined preprocessing on the metal material; a measurement instrument configured to measure information on the metal material during or after the press forming; and a control device configured to calculate a press forming condition for inhibiting occurrence of a forming defect for a subsequent metal material by inputting information on the metal material during or after the press forming measured by the measurement instrument to a machine learning model that uses, as input, the information on the metal material during or after the press forming and uses, as output, a press forming condition of the metal material for inhibiting the occurrence of a forming defect, and perform feedback control on at least one of the second press machine and the preprocessing device under the calculated press forming condition.

A press line according to a third aspect of the present invention includes: a first press machine configured to shear an outer peripheral portion of a metal material by using a blanking die; a second press machine configured to form a press-formed component by performing press forming on the metal material sheared by the first press machine with a forming die; a preprocessing device provided on a downstream side of the first press machine and configured to perform predetermined preprocessing on the metal material; a measurement instrument configured to measure a residual magnetic field of the metal material before shearing performed by the first press machine and/or a shear load of the metal material during the shearing performed by the first press machine; and a control device configured to calculate a press forming condition for inhibiting occurrence of cracking for a metal material to be formed by inputting the residual magnetic field of the metal material before the shearing performed by the first press machine and/or the shear load of the metal material during the shearing performed by the first press machine, which has been measured by the measurement instrument, and manufacturing information of the metal material to a machine learning model that uses, as input, the residual magnetic field of the metal material before the shearing performed by the first press machine and/or the shear load of the metal material during the shearing performed by the first press machine and the manufacturing information of the metal material and uses, as output, the press forming condition of the metal material for inhibiting occurrence of cracking of the metal material, and perform feedforward control on at least one of the second press machine and the preprocessing device under the calculated press forming condition.

A press line according to a fourth aspect of the present invention includes: a first press machine configured to shear an outer peripheral portion of a metal material by using a blanking die; a second press machine configured to form a press-formed component by performing press forming on the metal material sheared by the first press machine with a forming die; a preprocessing device provided on a downstream side of the first press machine and configured to perform predetermined preprocessing on the metal material; a measurement instrument configured to measure information on the metal material during or after the press forming; and a control device configured to calculate a press forming condition for inhibiting occurrence of cracking of a subsequent metal material by inputting information on the metal material during or after the press forming measured by the measurement instrument to a machine learning model that uses, as input, the information on the metal material during or after the press forming and uses, as output, a press forming condition of the metal material for inhibiting the occurrence of cracking of the metal material, and perform feedback control on at least one of the second press machine and the preprocessing device under the calculated press forming condition.

A press line according to a fifth aspect of the present invention includes: a first press machine configured to shear an outer peripheral portion of a metal material by using a blanking die; a second press machine configured to form a press-formed component by performing press forming on the metal material sheared by the first press machine with a forming die; a preprocessing device provided on a downstream side of the first press machine and configured to perform predetermined preprocessing on the metal material; a measurement instrument configured to measure a residual magnetic field of the metal material before shearing performed by the first press machine and/or a shear load of the metal material during the shearing performed by the first press machine; and a control device configured to calculate a press forming condition for inhibiting occurrence of a wrinkle for a metal material to be formed by inputting the residual magnetic field of the metal material before the shearing performed by the first press machine and/or the shear load of the metal material during the shearing performed by the first press machine, which has been measured by the measurement instrument, and manufacturing information of the metal material to a machine learning model that uses, as input, the residual magnetic field of the metal material before the shearing performed by the first press machine and/or the shear load of the metal material during the shearing performed by the first press machine and the manufacturing information of the metal material and uses, as output, the press forming condition of the metal material for inhibiting occurrence of a wrinkle of the metal material, and perform feedforward control on at least one of the second press machine and the preprocessing device under the calculated press forming condition.

A press line according to a sixth aspect of the present invention includes: a first press machine configured to shear an outer peripheral portion of a metal material by using a blanking die; a second press machine configured to form a press-formed component by performing press forming on the metal material sheared by the first press machine with a forming die; a preprocessing device provided on a downstream side of the first press machine and configured to perform predetermined preprocessing on the metal material; a measurement instrument configured to measure information on the metal material during or after the press forming; and a control device configured to calculate a press forming condition for inhibiting occurrence of a wrinkle of a subsequent metal material by inputting information on the metal material during or after the press forming measured by the measurement instrument to a machine learning model that uses, as input, the information on the metal material during or after the press forming and uses, as output, a press forming condition of the metal material for inhibiting the occurrence of a wrinkle of the metal material, and perform feedback control on at least one of the second press machine and the preprocessing device under the calculated press forming condition.

A press line according to a seventh aspect of the present invention includes: a first press machine configured to shear an outer peripheral portion of a metal material by using a blanking die; a second press machine configured to form a press-formed component by performing press forming on the metal material sheared by the first press machine with a forming die; a preprocessing device provided on a downstream side of the first press machine and configured to perform predetermined preprocessing on the metal material; a measurement instrument configured to measure at least one of a residual magnetic field of the metal material before shearing performed by the first press machine, a shear load of the metal material during the shearing performed by the first press machine, a shape of the metal material before the shearing performed by the second press machine, and an arrangement position of the metal material to the forming die; and a control device configured to calculate a press forming condition for inhibiting occurrence of a dimensional accuracy defect of the press-formed component for a metal material to be formed by inputting at least one of the residual magnetic field of the metal material before the shearing performed by the first press machine, the shear load of the metal material during the shearing performed by the first press machine, the shape of the metal material before the shearing performed by the second press machine, and the arrangement position of the metal material to the forming die, which have been measured by the measurement instrument, and manufacturing information of the metal material to a machine learning model that uses, as input, at least one of the residual magnetic field of the metal material before shearing performed by the first press machine, the shear load of the metal material during the shearing performed by the first press machine, the shape of the metal material before the shearing performed by the second press machine, and the arrangement position of the metal material to the forming die and the manufacturing information of the metal material and uses, as output, the press forming condition of the metal material for inhibiting the occurrence of a dimensional accuracy defect of the press-formed component, and perform feedforward control on at least one of the second press machine and the preprocessing device under the calculated press forming condition.

A press line according to an eighth aspect of the present invention includes: a first press machine configured to shear an outer peripheral portion of a metal material by using a blanking die; a second press machine configured to form a press-formed component by performing press forming on the metal material sheared by the first press machine with a forming die; a preprocessing device provided on a downstream side of the first press machine and configured to perform predetermined preprocessing on the metal material; a measurement instrument configured to measure information on a shape of the press-formed component; and a control device configured to calculate a press forming condition for inhibiting occurrence of a dimensional accuracy defect of a press-formed component for a subsequent metal material by inputting information on the shape of the press-formed component measured by the measurement instrument to a machine learning model that uses, as input, the information on the shape of the press-formed component and uses, as output, a press forming condition of the metal material for inhibiting the occurrence of the dimensional accuracy defect of the press-formed component, and perform feedback control on at least one of the second press machine and the preprocessing device under the calculated press forming condition.

A press line according to a ninth aspect of the present invention includes: a first press machine configured to shear an outer peripheral portion of a metal material by using a blanking die; a second press machine configured to form a press-formed component by performing press forming on the metal material sheared by the first press machine with a forming die; a preprocessing device provided on a downstream side of the first press machine and configured to perform predetermined preprocessing on the metal material; a measurement instrument configured to measure information on the metal material during or after the press forming; and a control device configured to calculate a press forming condition for inhibiting occurrence of die damage and a surface quality defect of the press-formed component caused by the die damage for a subsequent metal material by inputting information on the metal material during or after the press forming measured by the measurement instrument to a machine learning model that uses, as input, the information on the metal material during or after the press forming and uses, as output, a press forming condition of the metal material for inhibiting the occurrence of die damage and a surface quality defect of the press-formed component caused by the die damage, and perform feedback control on at least one of the second press machine and the preprocessing device under the calculated press forming condition.

A press forming condition calculation method according to a first aspect of the present invention includes a step of calculating a press forming condition for inhibiting occurrence of a forming defect for a metal material to be formed by inputting a material characteristic value of the metal material to be formed and manufacturing information to a machine learning model that uses, as input, the material characteristic value of the metal material and the manufacturing information and uses, as output, the press forming condition of the metal material for inhibiting the occurrence of a forming defect.

A press forming condition calculation method according to a second aspect of the present invention includes a step of calculating a press forming condition for inhibiting occurrence of a forming defect for a metal material to be formed by inputting information on the metal material during or after press forming to a machine learning model that uses, as input, the information on the metal material during or after the press forming and uses, as output, the press forming condition of the metal material for inhibiting the occurrence of a forming defect.

A press forming condition calculation method according to a third aspect of the present invention includes a step of calculating a press forming condition for inhibiting occurrence of cracking of a metal material to be formed by inputting a residual magnetic field of the metal material before shearing performed by a press machine configured to shear an outer peripheral portion of the metal material by using a blanking die and/or a shear load of the metal material during the shearing performed by the press machine and manufacturing information of the metal material to a machine learning model that uses, as input, the residual magnetic field of the metal material before the shearing performed by the press machine and/or the shear load of the metal material during the shearing performed by the press machine and the manufacturing information of the metal material and uses, as output, the press forming condition of the metal material for inhibiting the occurrence of cracking of the metal material.

A press forming condition calculation method according to a fourth aspect of the present invention includes a step of calculating a press forming condition for inhibiting occurrence of cracking of a subsequent metal material by inputting information on the metal material during or after press forming to a machine learning model that uses, as input, the information on the metal material during or after the press forming and uses, as output, the press forming condition of the metal material for inhibiting the occurrence of cracking of the metal material.

A press forming condition calculation method according to a fifth aspect of the present invention includes a step of calculating a press forming condition for inhibiting occurrence of a wrinkle of a metal material to be formed by inputting a residual magnetic field of the metal material before shearing performed by a press machine configured to shear an outer peripheral portion of the metal material by using a blanking die and/or a shear load of the metal material during the shearing performed by the press machine and manufacturing information of the metal material to a machine learning model that uses, as input, the residual magnetic field of the metal material before the shearing performed by the press machine and/or the shear load of the metal material during the shearing performed by the press machine and the manufacturing information of the metal material and uses, as output, the press forming condition of the metal material for inhibiting the occurrence of a wrinkle of the metal material.

A press forming condition calculation method according to a sixth aspect of the present invention includes a step of calculating a press forming condition for inhibiting occurrence of a wrinkle of a subsequent metal material by inputting information on the metal material during or after press forming to a machine learning model that uses, as input, the information on the metal material during or after the press forming and uses, as output, the press forming condition of the metal material for inhibiting the occurrence of a wrinkle of the metal material.

A press forming condition calculation method according to a seventh aspect of the present invention includes a step of calculating a press forming condition for inhibiting occurrence of a dimensional accuracy defect of a press-formed component for a metal material to be formed by inputting at least one of a residual magnetic field of the metal material before shearing performed by a first press machine configured to shear an outer peripheral portion of the metal material by using a blanking die, a shear load of the metal material during the shearing performed by the first press machine, a shape of the metal material before shearing performed by a second press machine configured to form the press-formed component by performing press forming on the metal material sheared by the first press machine with a forming die, and an arrangement position of the metal material to the forming die and manufacturing information of the metal material to a machine learning model that uses, as input, at least one of the residual magnetic field of the metal material before the shearing performed by the first press machine, the shear load of the metal material during the shearing performed by the first press machine, the shape of the metal material before the shearing performed by the second press machine, and the arrangement position of the metal material to the forming die and the manufacturing information of the metal material and uses, as output, the press forming condition of the metal material for inhibiting the occurrence of the dimensional accuracy defect of the press-formed component.

A press forming condition calculation method according to an eighth aspect of the present invention includes a step of calculating a press forming condition for inhibiting occurrence of a dimensional accuracy defect of a press-formed component for a subsequent metal material by inputting information on a shape of the press-formed component after press forming to a machine learning model that uses, as input, information on the shape of the press-formed component formed by performing the press forming on a metal material with a forming die and uses, as output, the press forming condition of the metal material for inhibiting the occurrence of the dimensional accuracy defect of the press-formed component.

A press forming condition calculation method according to a ninth aspect of the present invention includes a step of calculating a press forming condition for inhibiting occurrence of die damage and a surface quality defect of a press-formed component caused by the die damage for a subsequent metal material by inputting information on a metal material during or after press forming to a machine learning model that uses, as input, information on the metal material during or after press forming and uses, as output, the press forming condition of the metal material for inhibiting the occurrence of the die damage and the surface quality defect of the press-formed component caused by the die damage.

A press forming condition calculation program according to a first aspect of the present invention causes a computer to execute calculating a press forming condition for inhibiting occurrence of a forming defect for a metal material to be formed by inputting a material characteristic value of the metal material to be formed and manufacturing information to a machine learning model that uses, as input, the material characteristic value of the metal material and the manufacturing information and uses, as output, the press forming condition of the metal material for inhibiting the occurrence of a forming defect.

A press forming condition calculation program according to a second aspect of the present invention causes a computer to execute calculating a press forming condition for inhibiting occurrence of a forming defect for a metal material to be formed by inputting information on the metal material during or after press forming to a machine learning model that uses, as input, the information on the metal material during or after the press forming and uses, as output, the press forming condition of the metal material for inhibiting the occurrence of a forming defect.

A press forming condition calculation program according to a third aspect of the present invention causes a computer to execute calculating a press forming condition for inhibiting occurrence of cracking of a metal material to be formed by inputting a residual magnetic field of the metal material before shearing performed by a press machine configured to shear an outer peripheral portion of the metal material by using a blanking die and/or a shear load of the metal material during the shearing performed by the press machine and manufacturing information of the metal material to a machine learning model that uses, as input, the residual magnetic field of the metal material before the shearing performed by the press machine and/or the shear load of the metal material during the shearing performed by the press machine and the manufacturing information of the metal material and uses, as output, the press forming condition of the metal material for inhibiting the occurrence of cracking of the metal material.

A press forming condition calculation program according to a fourth aspect of the present invention causes a computer to execute calculating a press forming condition for inhibiting occurrence of cracking of a subsequent metal material by inputting information on the metal material during or after press forming to a machine learning model that uses, as input, the information on the metal material during or after the press forming and uses, as output, the press forming condition of the metal material for inhibiting the occurrence of cracking of the metal material.

A press forming condition calculation program according to a fifth aspect of the present invention causes a computer to execute calculating a press forming condition for inhibiting occurrence of a wrinkle of a metal material to be formed by inputting a residual magnetic field of the metal material before shearing performed by a press machine configured to shear an outer peripheral portion of the metal material by using a blanking die and/or a shear load of the metal material during the shearing performed by the press machine and manufacturing information of the metal material to a machine learning model that uses, as input, the residual magnetic field of the metal material before the shearing performed by the press machine and/or the shear load of the metal material during the shearing performed by the press machine and the manufacturing information of the metal material and uses, as output, the press forming condition of the metal material for inhibiting the occurrence of a wrinkle of the metal material.

A press forming condition calculation program according to a sixth aspect of the present invention causes a computer to execute calculating a press forming condition for inhibiting occurrence of a wrinkle of a subsequent metal material by inputting information on the metal material during or after press forming to a machine learning model that uses, as input, the information on the metal material during or after the press forming and uses, as output, the press forming condition of the metal material for inhibiting the occurrence of a wrinkle of the metal material.

A press forming condition calculation program according to a seventh aspect of the present invention causes a computer to execute calculating a press forming condition for inhibiting occurrence of a dimensional accuracy defect of a press-formed component for a metal material to be formed by inputting at least one of a residual magnetic field of the metal material before shearing performed by a first press machine configured to shear an outer peripheral portion of the metal material by using a blanking die, a shear load of the metal material during the shearing performed by the first press machine, a shape of the metal material before shearing performed by a second press machine configured to form the press-formed component by performing press forming on the metal material sheared by the first press machine with a forming die, and an arrangement position of the metal material to the forming die and manufacturing information of the metal material to a machine learning model that uses, as input, at least one of the residual magnetic field of the metal material before the shearing performed by the first press machine, the shear load of the metal material during the shearing performed by the first press machine, the shape of the metal material before the shearing performed by the second press machine, and the arrangement position of the metal material to the forming die and the manufacturing information of the metal material and uses, as output, the press forming condition of the metal material for inhibiting the occurrence of the dimensional accuracy defect of the press-formed component.

A press forming condition calculation program according to an eighth aspect of the present invention causes a computer to execute calculating a press forming condition for inhibiting occurrence of a dimensional accuracy defect of a press-formed component for a subsequent metal material by inputting information on a shape of the press-formed component after press forming to a machine learning model that uses, as input, information on the shape of the press-formed component formed by performing the press forming on a metal material with a forming die and uses, as output, the press forming condition of the metal material for inhibiting the occurrence of the dimensional accuracy defect of the press-formed component.

A press forming condition calculation program according to a ninth aspect of the present invention causes a computer to execute calculating a press forming condition for inhibiting occurrence of die damage and a surface quality defect of a press-formed component caused by the die damage for a subsequent metal material by inputting information on a metal material during or after press forming to a machine learning model that uses, as input, information on the metal material during or after press forming and uses, as output, the press forming condition of the metal material for inhibiting the occurrence of the die damage and the surface quality defect of the press-formed component caused by the die damage.

According to a press line according to aspects of the present invention, occurrence of a forming defect can be inhibited without requiring much labor and cost. According to a press forming condition calculation method and a press forming condition calculation program according to aspects of the present invention, a press forming condition for inhibiting the occurrence of a forming defect can be calculated. According to the press line according to aspects of the present invention, occurrence of cracking of a metal material can be inhibited without requiring much labor and cost. According to the press forming condition calculation method and the press forming condition calculation program according to aspects of the present invention, a press forming condition for inhibiting the occurrence of cracking of a metal material can be calculated. According to the press line according to aspects of the present invention, occurrence of a wrinkle of a metal material can be inhibited without requiring much labor and cost. According to the press forming condition calculation method and the press forming condition calculation program according to aspects of the present invention, a press forming condition for inhibiting the occurrence of a wrinkle of a metal material can be calculated. According to the press line according to aspects of present invention, occurrence of a dimensional accuracy defect of a press-formed component can be inhibited without requiring much labor and cost. According to the press forming condition calculation method and the press forming condition calculation program according to aspects of the present invention, a press forming condition for inhibiting the occurrence of the dimensional accuracy defect of a press-formed component can be calculated. According to the press line according to aspects of the present invention, occurrence of die damage and a surface quality defect of a press-formed component caused by the die damage can be inhibited without requiring much labor and cost. According to the press forming condition calculation method and the press forming condition calculation program according to aspects of the present invention, a press forming condition for inhibiting the occurrence of the die damage and the surface quality defect of a press-formed component caused by the die damage can be inhibited.

DETAILED DESCRIPTION OF EMBODIMENTS OF THE INVENTION

Configurations of press lines according to first to third embodiments of the present invention will be described below with reference to the drawings.

[Configuration of Common Press Line]

First, a configuration of a common press line will be described with reference to FIGS. 1 and 2.

Figure 1:
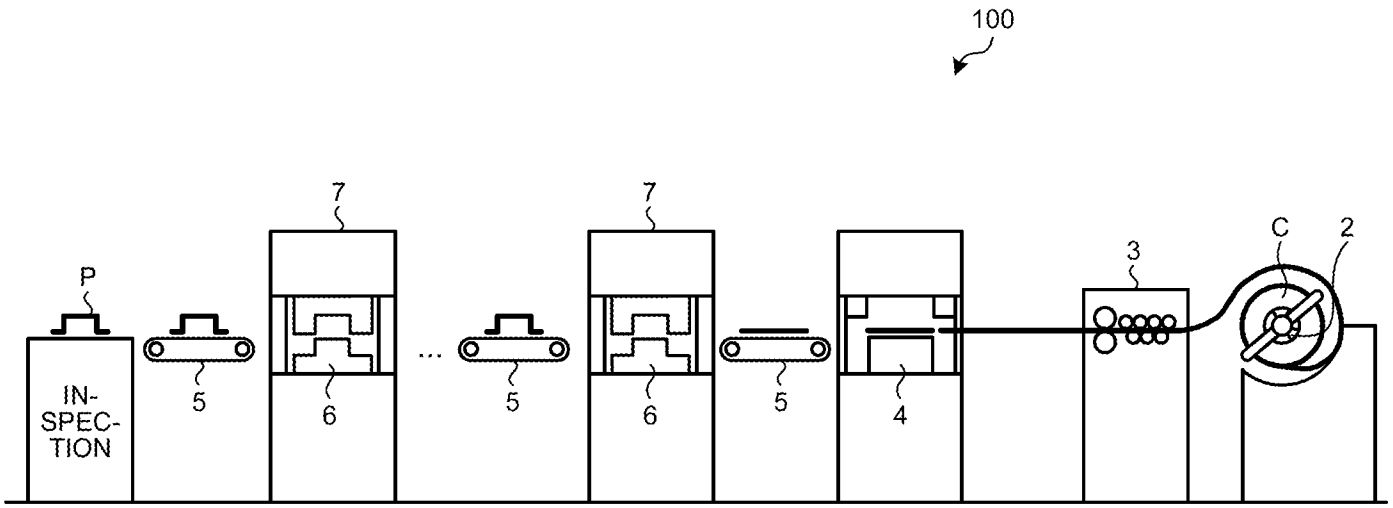
FIG. 1 is a schematic diagram illustrating a configuration of a common press line.

FIG. 1 is a schematic diagram illustrating a configuration of a common press line. As illustrated in FIG. 1, in a common press line 100, a coiled metal material (hereinafter, referred to as coil material) C shipped from a material manufacturer is first attached to a pay-off reel 2 disposed at the beginning of the press line 100. Next, the coil material C is unwound by an uncoiler leveler 3 or the like, and then inserted into the press line 100. Next, a blanking process of cutting the outer periphery of a target press-formed component from the coil material C in accordance with the shape of the press-formed component is performed. A press machine including a blanking die 4 performs the blanking process. The blanking die 4 includes an upper die and a lower die. The upper die includes an upper blade and a sheet presser. The lower die includes a lower blade.

Next, the coil material C is conveyed to a mechanical press machine 7 by a conveying device 5 such as a belt conveyor, a robot arm, and a feeder. The mechanical press machine 7 includes a forming die 6 including an upper die and a lower die. A press forming process of forming the coil material C into a target shape by performing drawing and bending forming is performed. In general, a press forming process for a vehicle body component of an automobile includes approximately one to five processes, and includes a shear process in addition to the press forming. The shear process includes a trimming process of trimming an excess material and a piercing process of piercing a hole. A press-formed component P subjected to all the processes is inspected. If there is no problem in quality, the press-formed component P is conveyed to a product assembly line.

Note that, in general, the above-described press line 100 includes a tandem press line and a transfer press line. In the tandem press line, the conveying device 5 conveys the coil material C between independent mechanical press machines 7. In the transfer press line, dies for a plurality of processes are installed in one mechanical press machine 7, and a feeder device in the mechanical press machine 7 conveys the coil material C between the dies. Furthermore, in another form of the press line 100, as illustrated in FIG. 2, the coil material C shipped from a material manufacturer may be once blanked in, for example, a coil center. The coil material C may then be delivered as a plate material to a factory where press forming is performed.

Figure 2:
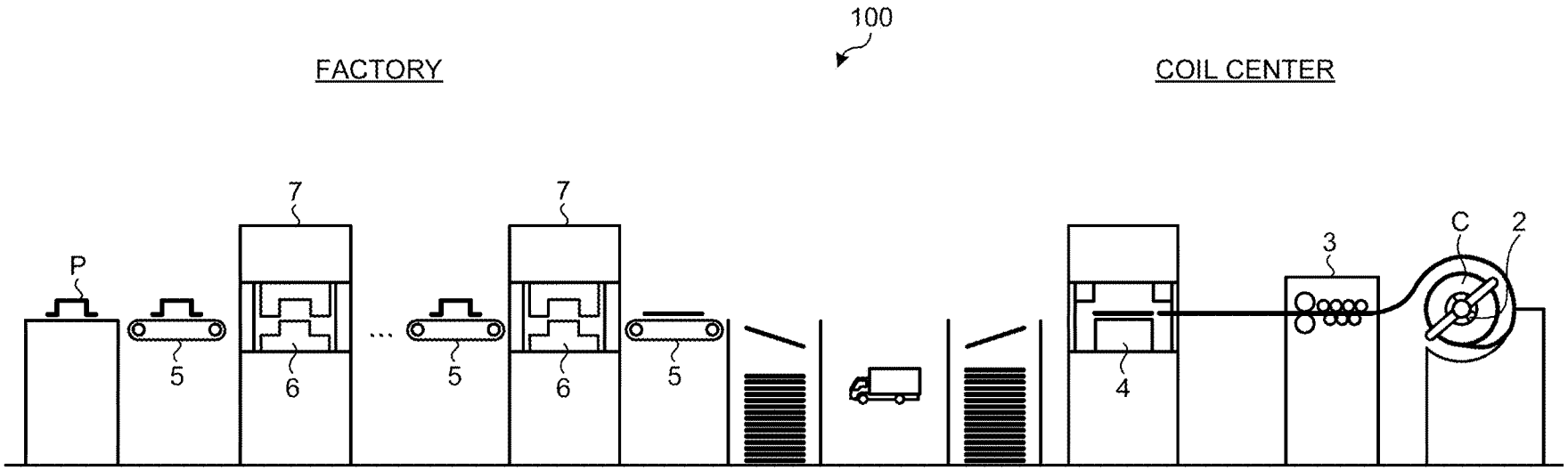
FIG. 2 is a schematic diagram illustrating a configuration of a variation of the press line in FIG. 1.

In the common press line 100 as illustrated in FIGS. 1 and 2, when a forming defect (e.g., cracking, wrinkle, surface strain, and dimensional accuracy defect of coil material C), die damage, or a surface quality defect of a press-formed component caused by the die damage occurs during mass production press forming, the mass production press forming is temporarily interrupted, and the cause is investigated. Measures thereagainst include changing the coil material C to another lot material or a material of another material manufacturer, performing correction such as partially scraping and polishing the die, and correcting a press forming condition of the mechanical press machine 7. This needs much labor and cost before resumption of the mass production press forming, so that measures are required. Therefore, with the configurations to be described below, the press lines according to the first to third embodiments of the present invention inhibit occurrence of a forming defect, die damage, and a surface quality defect of a press-formed component caused by the die damage without requiring much labor and cost. The configurations of the press lines according to the first to third embodiments of the present invention will be described below with reference to FIGS. 3 to 9.

[First Embodiment]

Figure 3:
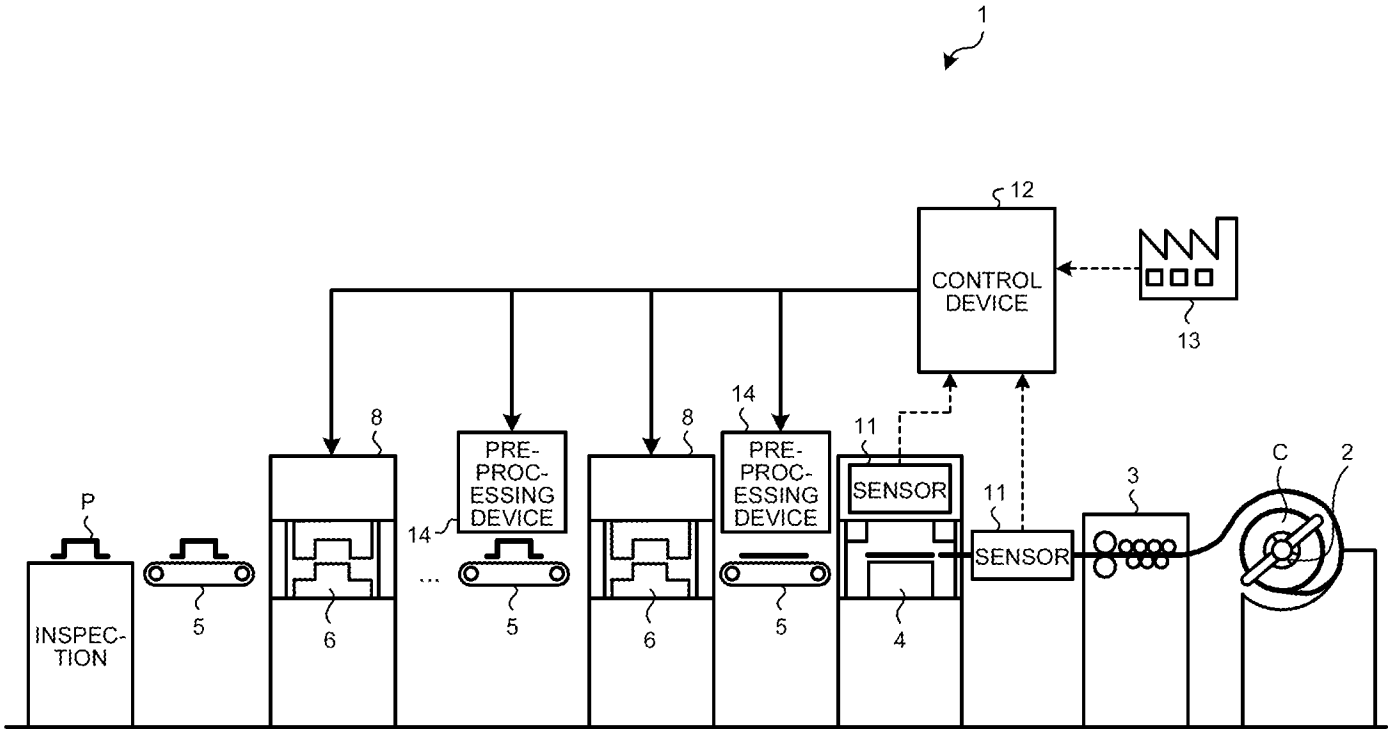
FIG. 3 is a schematic diagram illustrating a configuration of a press line according to a first embodiment of the present invention.

FIG. 3 is a schematic diagram illustrating a configuration of a press line according to a first embodiment of the present invention. As illustrated in FIG. 3, unlike the common press line 100 in FIG. 1, a press line 1 according to the first embodiment of the present invention includes one or more sensors 11 on the upstream side of a servo press machine 8 (or servo die cushion device) that performs a press forming process. Specifically, the sensor 11 is installed before a blanking process or in a press machine or the blanking die 4 that performs the blanking process. The sensor 11 includes, for example, a shape measuring instrument, a thermometer, a load meter, and a magnetic field measuring instrument. The sensor 11 measures information on a material characteristic value of the coil material C before press forming, such as yield strength, tensile strength, elongation, an n-value, an r-value, a hole expansion ratio, hardness, temperature, and shape.

Furthermore, the press line 1 according to the first embodiment of the present invention includes a control device 12. Details of the control device 12 will be described later. The control device 12 includes a machine learning model that uses, as input, the material characteristic value of the coil material C and manufacturing information and uses, as output, a press forming condition of the coil material C for inhibiting occurrence of a forming defect, die damage, and a surface quality defect of a press-formed component caused by the die damage. The control device 12 inputs the material characteristic value of the coil material C to be formed and manufacturing information measured by the sensor 11 to the machine learning model to calculate the press forming condition for inhibiting the occurrence of a forming defect, die damage, and a surface quality defect of a press-formed component caused by the die damage for the coil material C to be formed. Examples of the calculated press forming condition include a forming load, forming motion, and wrinkle pressing force. Then, the control device 12 performs feedforward control on at least one of the servo press machine 8 and a preprocessing device 14 provided on the downstream side of the blanking process under the calculated press forming condition. An instrument capable of changing the press forming condition, such as a movable die mechanism, a cam mechanism, and a distance block is provided on the forming die 6 of the servo press machine 8. The distance block can change a height and a standby position. Furthermore, examples of the preprocessing device 14 include a device that sprays lubricating oil to the coil material C and a heating device that heats the coil material C.

Note that the manufacturing information of the coil material C includes information on a component of the coil material C, a heat treatment condition, a rolling condition, and the like. The manufacturing information of the coil material C is provided from the side of a material manufacturing factory 13, and is associated with an identifier such as an IC chip, a QR code (registered trademark), and a barcode assigned to the coil material C. Each time the coil material C is replaced, the control device 12 acquires manufacturing information of the coil material C by reading an identifier with a reading device.

Figure 4:
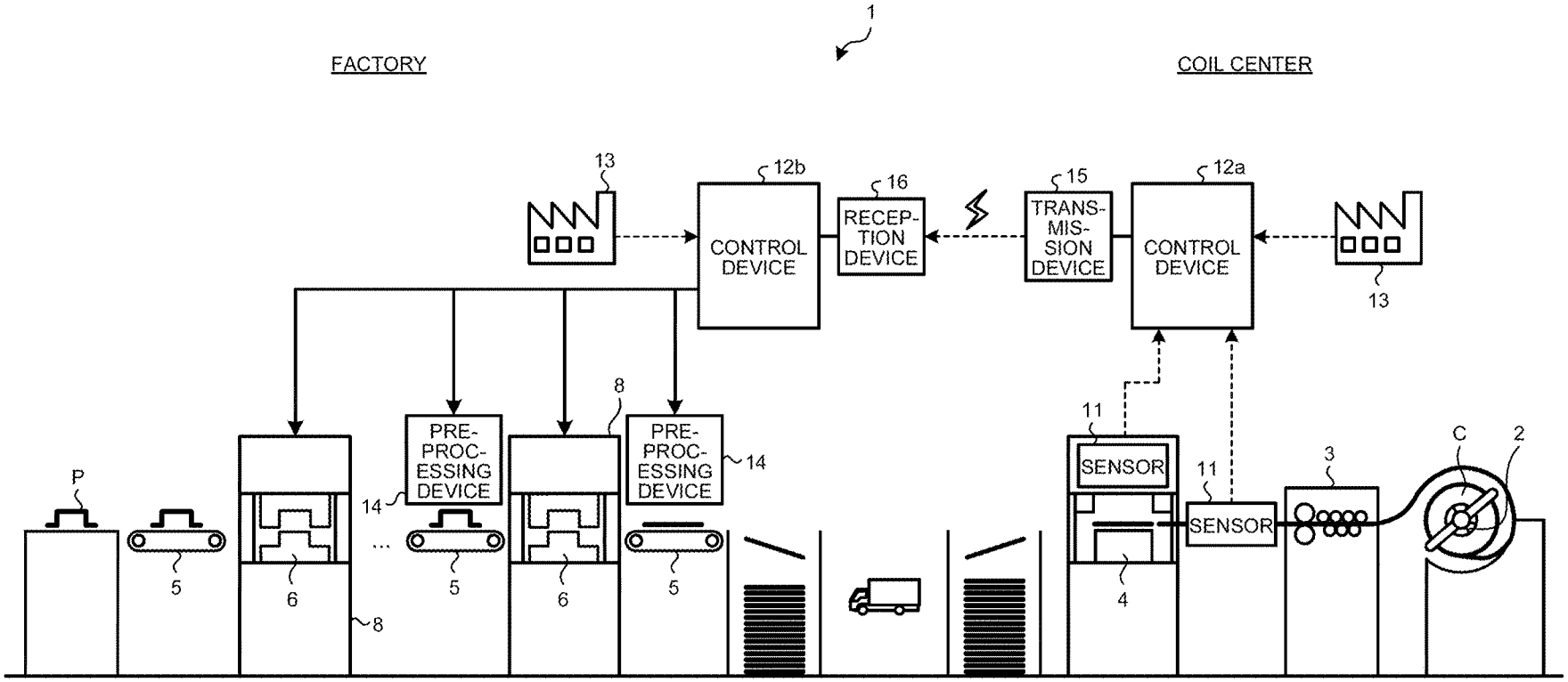
FIG. 4 is a schematic diagram illustrating a configuration of a variation of the press line in FIG. 3.

Furthermore, as illustrated in FIG. 4, also in the case of the press line 1 in which a factory that blanks the coil material C is different from a factory that performs press forming, the sensor 11 is installed before a blanking process or in a press machine or the blanking die 4 that performs blanking. Note, however, that, in this case, information measured by the sensor 11 is input to a control device 12*a* provided on the side of a factory (coil center) that blanks the coil material C, and then transmitted to a control device 12*b* provided on the side of a factory that performs press forming by a transmission device 15 and a reception device 16 via a telecommunication line such as the Internet.

[Second Embodiment]

Figure 5:
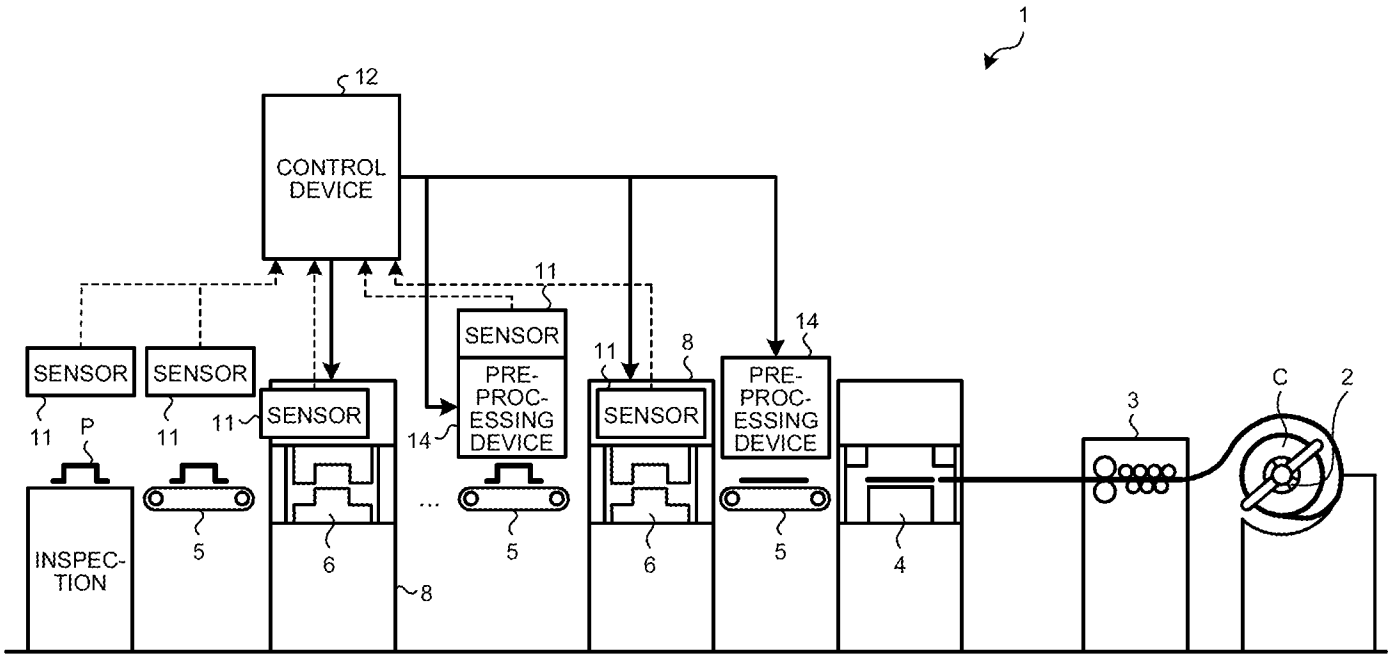
FIG. 5 is a schematic diagram illustrating a configuration of a press line according to a second embodiment of the present invention.

FIG. 5 is a schematic diagram illustrating a configuration of a press line according to a second embodiment of the present invention. As illustrated in FIG. 5, unlike the common press line 100 in FIG. 1, a press line 1 according to the second embodiment of the present invention includes one or more sensors 11 on the downstream side of a servo press machine 8 (or servo die cushion device) that performs a press forming process. Specifically, the sensor 11 is provided in a forming die 6, the servo press machine 8, a conveying device 5, and an inspection process. The sensor 11 includes a microphone, acoustic emission, a camera, a thermometer, a load meter, a received-laser beam meter, a displacement meter, and a shape measuring instrument. The sensor 11 measures information on the coil material C during or after press forming, such as sound, vibration, a product image, temperature, a load, light, and shape.

Furthermore, the press line 1 according to the second embodiment of the present invention includes a control device 12. Details of the control device 12 will be described later. The control device 12 includes a machine learning model that uses, as input, information on the coil material C during or after press forming and uses, as output, a press forming condition of the coil material C for inhibiting occurrence of a forming defect, die damage, and a surface quality defect of a press-formed component caused by the die damage. The control device 12 inputs the information on the coil material C during or after press forming measured by the sensor 11 to the machine learning model to calculate the press forming condition for inhibiting the occurrence of a forming defect, die damage, and a surface quality defect of a press-formed component caused by the die damage for the coil material C to be press-formed later. Examples of the calculated press forming condition include a forming load, forming motion, and wrinkle pressing force. Then, the control device 12 performs feedback control on at least one of the servo press machine 8 and a preprocessing device 14 provided on the downstream side of the blanking process under the calculated press forming condition. An instrument capable of changing the press forming condition, such as a movable die mechanism, a cam mechanism, and a distance block is provided on the forming die 6 of the servo press machine 8. The distance block can change a height and a standby position. Furthermore, examples of the preprocessing device 14 include a device that sprays lubricating oil to the coil material C and a heating device that heats the coil material C.

Figure 6:
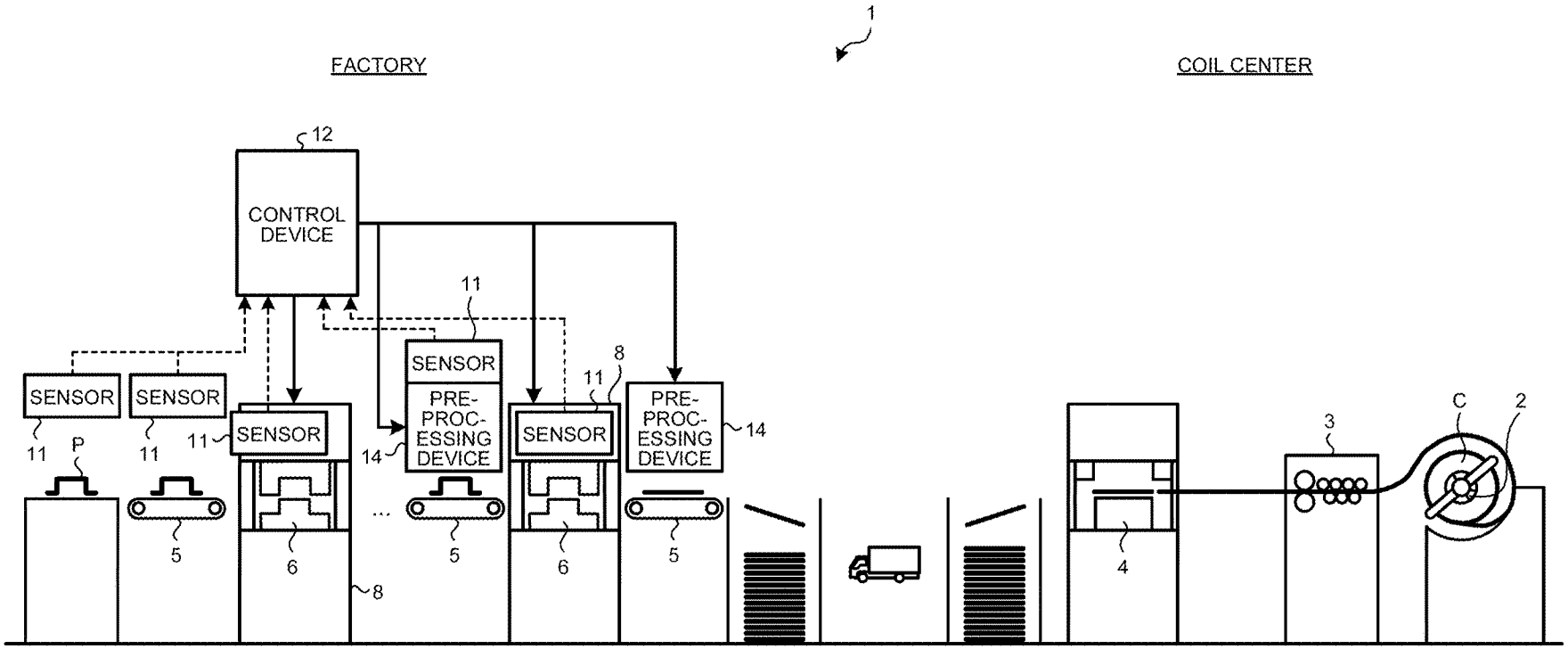
FIG. 6 is a schematic diagram illustrating a configuration of a variation of the press line in FIG. 5.

Note that the manufacturing information of the coil material C includes information on a component of the coil material C, a heat treatment condition, a rolling condition, and the like. The manufacturing information of the coil material C is associated with an identifier such as an IC chip, a QR code (registered trademark), and a barcode assigned to the coil material C. Each time the coil material C is replaced, the control device 12 acquires manufacturing information of the coil material C by reading an identifier with a reading device. Furthermore, as illustrated in FIG. 6, also in the case of the press line 1 in which a factory that blanks the coil material C is different from a factory that performs press forming, one or more sensors 11 is installed on the downstream side of the servo press machine 8 that performs a press forming process, and the feedback control is performed by the control device 12.

[Third Embodiment]

Figure 7:
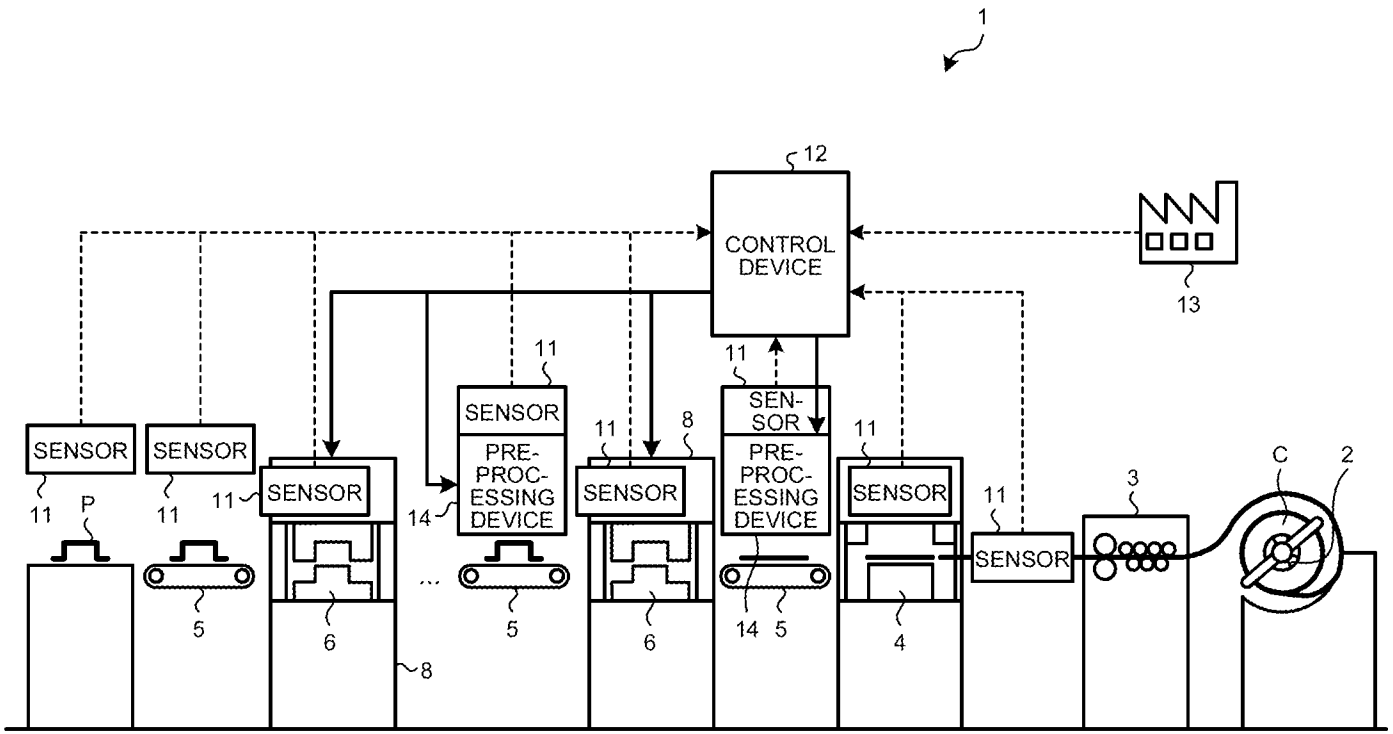
FIG. 7 is a schematic diagram illustrating a configuration of a press line according to a third embodiment of the present invention.
Figure 8:
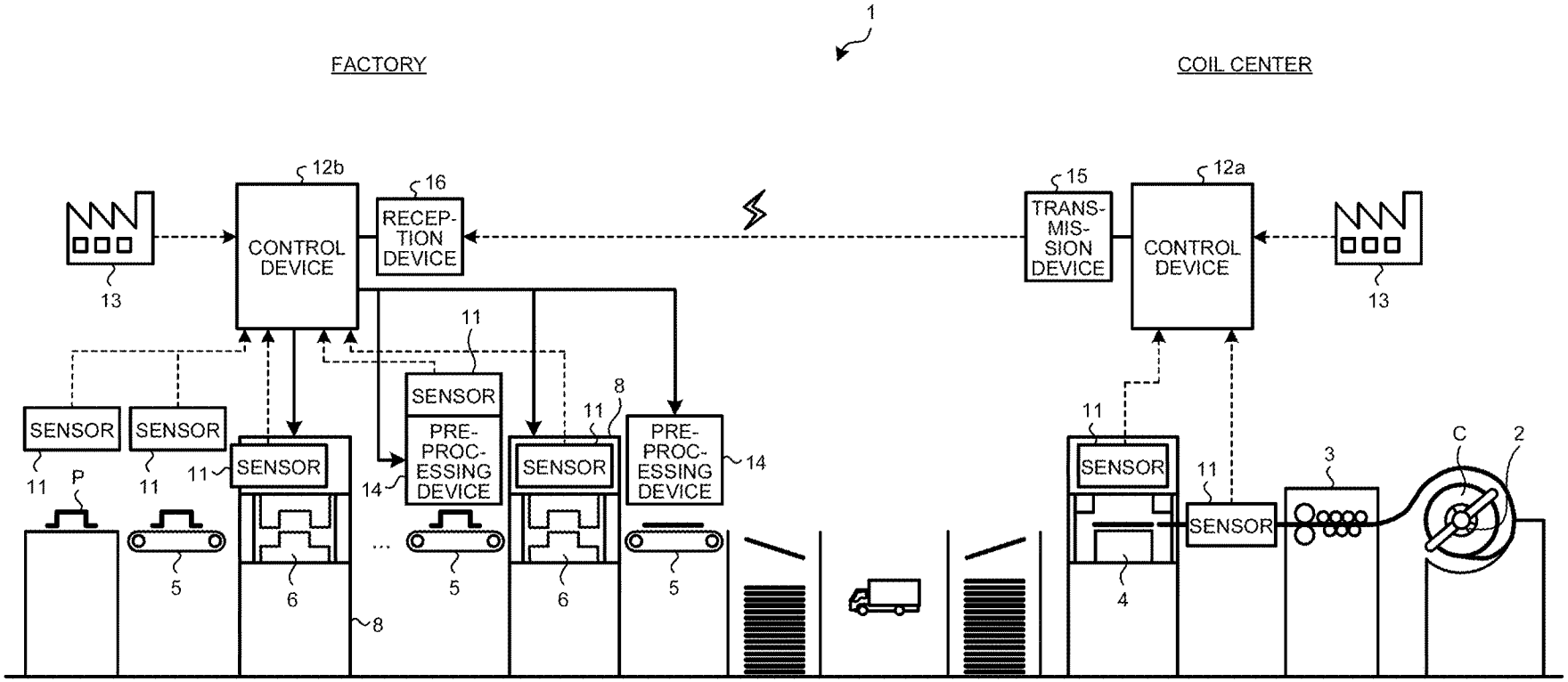
FIG. 8 is a schematic diagram illustrating a configuration of a variation of the press line in FIG. 7.

FIG. 7 is a schematic diagram illustrating a configuration of a press line according to a third embodiment of the present invention. As illustrated in FIG. 7, a press line 1 according to the third embodiment of the present invention is configured by a combination of the press line 1 according to the first embodiment of the present invention in FIG. 3 and the press line 1 according to the second embodiment of the present invention in FIG. 5. Furthermore, also in the case where a factory that blanks the coil material C is different from a factory that performs press forming, as illustrated in FIG. 8, the press line 1 can be configured by combining the press line 1 in FIG. 4 and the press line 1 in FIG. 6.

[Configuration of Control Device]

Next, configurations of the control devices 12 according to the first to fifth embodiments in the press line 1 will be described. Note that the functions of the control devices 12 to be described later are implemented by an internal arithmetic device 122 executing a program. The program may be provided by being recorded in a computer-readable recording medium such as a CD-ROM, a flexible disk, a CD-R, and a DVD as a file in an installable format or an executable format. The program may be stored in a computer connected to a network including a telecommunication line such as the Internet, a telephone communication network for mobile phones and the like, and a wireless communication network such as WiFi (registered trademark), and provided by being downloaded via the network.

[First Embodiment]

Figure 9:
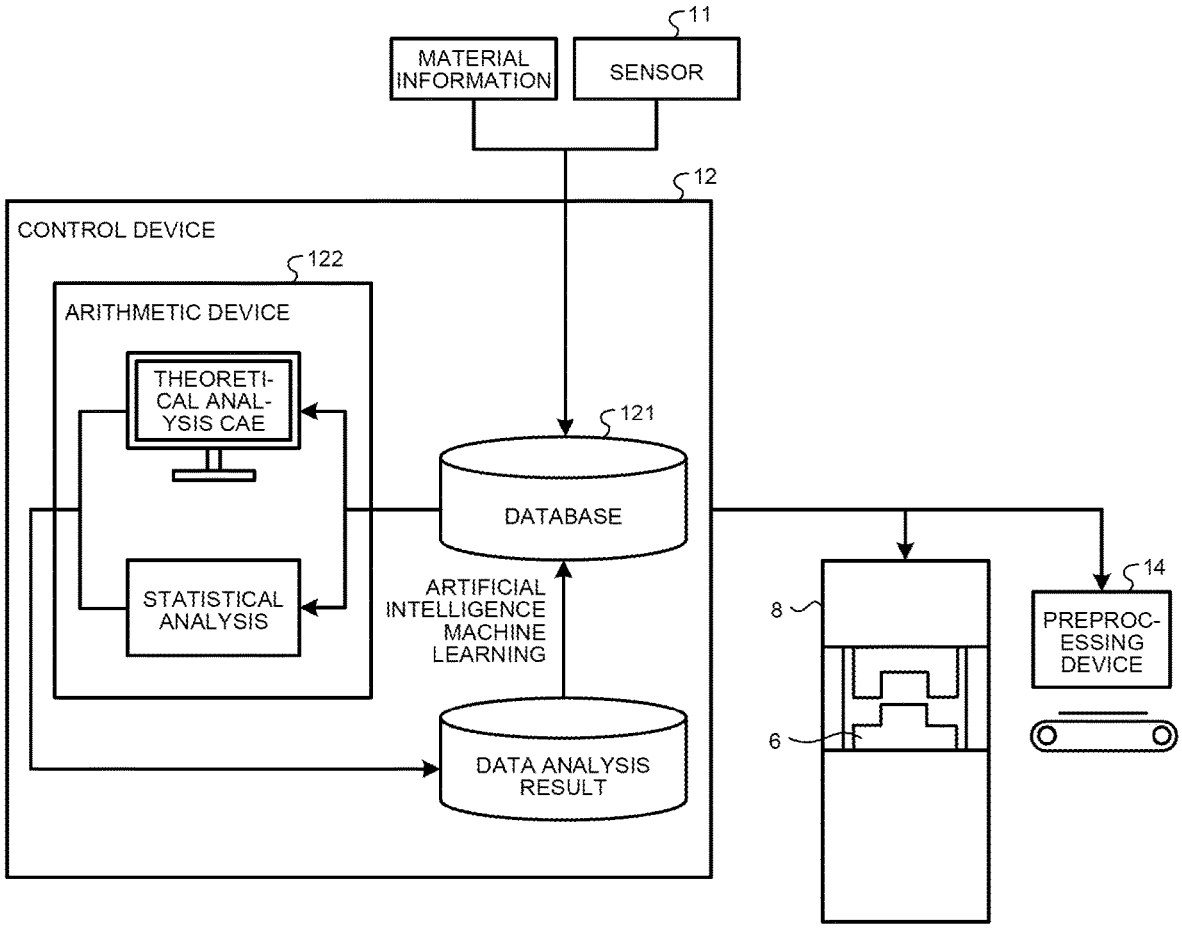
FIG. 9 is a block diagram illustrating a configuration of a control device according to the first to fifth embodiments of the present invention.

FIG. 9 is a block diagram illustrating a configuration of a control device according to the first to fifth embodiments of the present invention. As illustrated in FIG. 9, a control device 12 according to the first embodiment of the present invention includes an information processing device such as a computer and a workstation, and includes a database 121 and an arithmetic device 122.

The database 121 includes a nonvolatile storage device, and stores a material characteristic value of a coil material C before press forming measured by a sensor 11, information on the coil material C during or after press forming, and manufacturing information (hereinafter, referred to as input information) of the coil material C.

The arithmetic device 122 includes a CPU inside the information processing device, and controls the operation of the entire control device 12. In the embodiment, the arithmetic device 122 qualitatively or quantitatively predicts a press forming result such as whether or not or how much a forming defect has occurred in accordance with an input value by performing theoretical analysis based on CAE technology or arithmetic operation such as a finite element method (FEM) using a material characteristic value of the coil material C and a press forming condition stored in the database 121 as the input value. Unfortunately, current theoretical analysis and an accuracy of predicting a forming defect based on the FEM is unreliable, so that an error occurs between a predicted value and an actual value of the press forming result.

Therefore, the arithmetic device 122 determines the directionality of the press forming condition for inhibiting the occurrence of a forming defect based on a prediction result of the press forming result. Furthermore, the arithmetic device 122 corrects the press forming condition in a direction of inhibiting the occurrence of a forming defect by complementing the error of the predicted value of the press forming result based on a result of analyzing actual values of mass production press. Examples of a complementing method include a method using a complementing coefficient calculated by preliminarily and experimentally determining an error between a prediction result based on the CAE technology and an actual value and a method using a machine learning model for minimizing the above-described error. Then, the arithmetic device 122 stores data on material characteristics of the coil material C and a press forming result corresponding to the corrected press forming condition in the database 121.

Furthermore, the arithmetic device 122 performs statistical analysis by using data on a material characteristic value of the coil material C, a press forming condition, an actual press forming result, and the like. The arithmetic device 122 thereby analyzes the relation between the material characteristic value of the coil material C or the press forming condition and the press forming result, and stores an analysis result in the database 121. Furthermore, the arithmetic device 122 generates a machine learning model that uses, as input, the above-described input information and uses, as output, the press forming condition for inhibiting the occurrence of a forming defect by a method such as artificial intelligence and machine learning using the data stored in the database 121. Furthermore, the arithmetic device 122 inputs input information to the machine learning model in response to a command to calculate the press forming condition for inhibiting the occurrence of a forming defect to calculate a press forming condition for inhibiting the occurrence of a forming defect corresponding to the input information. The arithmetic device 122 controls the press line 1 under the calculated press forming condition.

[Second Embodiment]

In the second embodiment, the arithmetic device 122 determines the directionality of the press forming condition for inhibiting the occurrence of cracking of the coil material C based on a prediction result of the press forming result. Furthermore, the arithmetic device 122 corrects the press forming condition in a direction of inhibiting the occurrence of cracking of the coil material C by complementing the error of the predicted value of the press forming result based on a result of analyzing actual values of mass production press. Examples of a complementing method include a method using a complementing coefficient calculated by preliminarily and experimentally determining an error between a prediction result based on the CAE technology and an actual value and a method using a machine learning model for minimizing the above-described error. Then, the arithmetic device 122 stores data on material characteristics of the coil material C and a press forming result corresponding to the corrected press forming condition in the database 121.

Furthermore, the arithmetic device 122 performs statistical analysis by using data on a material characteristic value of the coil material C, a press forming condition, an actual press forming result, and the like. The arithmetic device 122 thereby analyzes the relation between the material characteristic value of the coil material C or the press forming condition and the press forming result, and stores an analysis result in the database 121. Furthermore, the arithmetic device 122 generates a machine learning model that uses, as input, the above-described input information and uses, as output, the press forming condition for inhibiting the occurrence of cracking of the coil material C by a method such as artificial intelligence and machine learning using the data stored in the database 121. Furthermore, the arithmetic device 122 inputs input information to the machine learning model in response to a command to calculate the press forming condition for inhibiting the occurrence of cracking of the coil material C to calculate a press forming condition for inhibiting the occurrence of cracking of the coil material C corresponding to the input information. Examples of the calculated press forming condition include a forming load, forming motion, and wrinkle pressing force. Then, the control device 12 performs feedback control on at least one of the servo press machine 8 and a preprocessing device 14 provided on the downstream side of the blanking process under the calculated press forming condition.

Note that, in particular, elongation, a hole expansion ratio, an n-value, and an r-value among material characteristic values of the coil material C have strong influence on the occurrence of cracking of the coil material C. Therefore, the control device 12 calculates an appropriate press forming condition by measuring and analyzing fluctuations of the above-described material characteristic values before press forming, and inhibits the occurrence of cracking of the coil material C by feedforward type control. In the embodiment, the control device 12 estimates ductility-related material characteristic values such as elongation, a hole expansion ratio, an n-value, and an r-value by associating an actually measured value of material strength (yield strength (YS) and tensile strength (TS)) measured in an in-line manner with manufacturing information of the coil material C by a method such as artificial intelligence and machine learning. As illustrated in Table 1 below, the information on material strength in this case can be measured by measuring a shear load at the time of blanking the coil material C and measuring a residual magnetic field after applying a pulse magnetic field to the coil material C before blanking.

In contrast, when cracking occurs in the coil material C, measured values of sound, vibration, an image, temperature, a load, a laser beam leakage amount area, die strain, and the like change during or after press forming. Therefore, in the embodiment, the control device 12 calculates an appropriate press forming condition by measuring fluctuation of a measured value and predicting and analyzing tendency of the measured value. The control device 12 inhibits the occurrence of cracking of the coil material C by feedback type control. As illustrated in Table 1 below, sound, vibration, and the like during press forming can be measured by a microphone and acoustic emission (AE). When cracking of the coil material C occurs, cracking sound and vibration of a press machine and a die caused by the occurrence of cracking occur. Thus, whether or not the cracking of the coil material C has occurred can be detected.

Furthermore, cracking can be directly detected by capturing an image of a press-formed component with a camera and analyzing the image. In addition, a change in a material inflow amount can be detected by analyzing an image of a profile of an edge of a material after drawing. A decrease in the material inflow amount increases a risk of the occurrence of cracking, so that a sign of cracking occurrence can be detected. Furthermore, temperature distribution in a press-formed component can be measured by measuring the temperature of the press-formed component during or after press forming by thermography. When a material is deformed by press forming, the material generates heat by processing. Thus, a portion where the material is deformed more greatly, that is, a portion with a higher risk of cracking occurrence has higher temperature. Therefore, not only cracking of the press-formed component but a state immediately before cracking such as necking can be detected.

In contrast, a heat storage amount in a die can be determined by measuring temperature distribution of the die. Heat storage of a die causes thermal expansion of the die made of cast metal or die steel, so that the distance between an upper die and a lower die of the die usually made with clearance corresponding to a sheet thickness changes. As a result, when the clearance between a die face and a wrinkle presser becomes narrower than the sheet thickness, the material inflow amount decreases. Thus, the risk of the occurrence of cracking increases. Furthermore, a forming load during press forming can be measured by a load meter such as a load cell directly installed, for example, in a press machine main body, between a slide of the press machine and the die, and in the die. When cracking occurs, the forming load decreases, noise occurs in the forming load, or a change occurs in forming load distribution in the die. Thus, whether or not cracking has occurred can be detected.

Furthermore, in a process after press forming, whether or not cracking has occurred can be measured by measuring an area of light leakage to an opposite surface caused by a crack at the time when the cracking has occurred by using an irradiation device and a light receiving device. The irradiation device irradiates the entire surface of a press-formed component with light such as a laser beam. The light receiving device receives light from the opposite surface. Furthermore, a strain of the die can be measured by a strain gauge attached to the die during press forming. When cracking occurs, slight deformation occurs depending on a portion of the die. Thus, at which position in the press-formed component the cracking has occurred can be detected.

TABLE 1

| Forming defect | Control type | Measurement target | Measurement method |
|---|---|---|---|
| Cracking | F/F | YS, TS | Shear load<br>Residual magnetic field |
| | F/B | Sound | Microphone |
| | | Vibration | AE |
| | | Image | Camera |
| | | Temperature | Thermography |
| | | Load | Load cell |
| | | Laser beam leakage area | Laser beam |
| | | Die strain | Strain gauge |

Furthermore, as illustrated in Table 2 below, the occurrence of cracking can be inhibited by changing forming motion of a servo press machine, wrinkle pressing pressure of a servo die cushion, a wrinkle presser standby position, pressure and standby position of a movable die in the die, height of a distance block, a material setting position, lubrication, and material temperature. Slide motion in usual press forming is crank motion by uniform circular motion. The occurrence of cracking can be inhibited by performing forming while reducing forming speed immediately before a forming bottom dead point or while stopping the slide motion a plurality of times in the middle of a bottom dead point stroke.

Furthermore, the servo die cushion increases the material inflow amount by reducing wrinkle pressing force in drawing or lowering the wrinkle presser standby position, and thereby the occurrence of cracking can be inhibited. Furthermore, outflow of material is increased by lowering the pressure of the movable die in the die or lowering the standby position of the movable die, and thereby the occurrence of cracking can be inhibited. Furthermore, for example, the clearance between the die face and the wrinkle presser is partially increased to have the sheet thickness or more by partially increasing heights of a plurality of distance blocks provided in the die, which can increase the material inflow amount. Thus, the occurrence of cracking can be inhibited.

Furthermore, if an arrangement position of the coil material C to the die deviates from a normal position at the time of conveyance, the balance of a material inflow amount changes at the time of press forming, which causes cracking. Therefore, the occurrence of cracking can be inhibited by arranging the coil material C at the normal arrangement position. Furthermore, in the preprocessing device, the material inflow amount is increased in drawing and the like by applying oil to the coil material C or the die with an oil spray before press forming, which can inhibit the occurrence of cracking. Furthermore, the coil material C at a portion where the occurrence of cracking is concerned is partially heated by a laser heater and the like before press forming to improve the ductility of the coil material C, which can inhibit the occurrence of cracking.

TABLE 2

| Control target | Control item | Expected effect to cracking inhibition |
|---|---|---|
| Servo press | Forming motion | Cracking is inhibited by reduction in forming speed before bottom dead point or multistage forming motion |
| | Wrinkle pressing pressure | Decreasing increases inflow amount, and cracking is inhibited |
| | Wrinkle presser standby position | Lowering increases inflow amount, and cracking is inhibited |
| Die | Pad pressure | Decreasing increases outflow amount, and cracking is inhibited |
| | Pad standby position | Decreasing increases outflow amount, and cracking is inhibited |
| | Distance block height<br>Stroke end<br>Holder end<br>Pad end | Increasing increases inflow amount, and cracking is inhibited |
| Conveyance | Material setting position | Cracking is inhibited by installing material at normal position |
| Preprocessing device | Oil spray | Inflow amount is increased by lubrication effect, and cracking is inhibited |
| | Laser heater | Cracking is inhibited by improvement of material ductility |

[Third Embodiment]

In the third embodiment, the arithmetic device 122 determines the directionality of the press forming condition for inhibiting the occurrence of a wrinkle of the coil material C based on a prediction result of the press forming result. Furthermore, the arithmetic device 122 corrects the press forming condition in a direction of inhibiting the occurrence of a wrinkle of the coil material C by complementing the error of the predicted value of the press forming result based on a result of analyzing actual values of mass production press. Examples of a complementing method include a method using a complementing coefficient calculated by preliminarily and experimentally determining an error between a prediction result based on the CAE technology and an actual value and a method using a machine learning model for minimizing the above-described error. Then, the arithmetic device 122 stores data on material characteristics of the coil material C and a press forming result corresponding to the corrected press forming condition in the database 121.

Furthermore, the arithmetic device 122 performs statistical analysis by using data on a material characteristic value of the coil material C, a press forming condition, an actual press forming result, and the like. The arithmetic device 122 thereby analyzes the relation between the material characteristic value of the coil material C or the press forming condition and the press forming result, and stores an analysis result in the database 121. Furthermore, the arithmetic device 122 generates a machine learning model that uses, as input, the above-described input information and uses, as output, the press forming condition for inhibiting the occurrence of a wrinkle of the coil material C by a method such as artificial intelligence and machine learning using the data stored in the database 121. Furthermore, the arithmetic device 122 inputs input information to the machine learning model in response to a command to calculate the press forming condition for inhibiting the occurrence of a wrinkle of the coil material C to calculate a press forming condition for inhibiting the occurrence of a wrinkle of the coil material C corresponding to the input information. Examples of the calculated press forming condition include a forming load, forming motion, and wrinkle pressing force. Then, the control device 12 performs feedback control on at least one of the servo press machine 8 and a preprocessing device 14 provided on the downstream side of the blanking process under the calculated press forming condition.

Note that, in particular, yield strength and tensile strength among the material characteristic values of the coil material C have strong influence on the occurrence of a wrinkle. Therefore, the control device 12 calculates an appropriate press forming condition by measuring and analyzing fluctuations of the material characteristic values before press forming, and inhibits the occurrence of a wrinkle by feed-forward type control. In the embodiment, the control device 12 estimates strength-related material characteristics such as yield strength (YS) and tensile strength (TS) by associating an actually measured value of material strength measured in an in-line manner with manufacturing information of the material by a method such as artificial intelligence and machine learning. As illustrated in Table 3 below, the information on material strength in this case can be measured by measuring a shear load at the time of blanking the material and measuring a residual magnetic field after applying a pulse magnetic field to the material before blanking.

In contrast, when a wrinkle occurs, measured values of an image, a zebra pattern, the shape, and the like of the coil material C change during or after press forming. Therefore, the control device 12 calculates an appropriate press forming condition by measuring fluctuation of a measured value and predicting and analyzing tendency of the measured value. The control device 12 inhibits the occurrence of a wrinkle by feedback type control. Whether or not there is a wrinkle can be directly detected by capturing an image of a press-formed component with a camera and detecting a shadow of the formed component by analyzing the image. In addition, a change in a material inflow amount can be detected by analyzing an image of a profile of an edge of a material after drawing. An increase in the material inflow amount increases a risk of the occurrence of a wrinkle, so that a sign of wrinkle occurrence can be detected. Furthermore, the position and degree of distortion of a surface can be measured by irradiating a surface of the press-formed component with stripes at equal intervals with a light source such as a light and analyzing an image of the reflected stripes. Furthermore, unevenness caused by wrinkles on the surface of the press-formed component can be directly measured by measuring the three-dimensional shape and the two-dimensional shape of the press-formed component with a shape measuring instrument.

TABLE 3

| Forming defect | Control type | Measurement target | Measurement method |
|---|---|---|---|
| Wrinkle | F/F | YS, TS | Shear load<br>Residual magnetic field |
| | F/B | Image | Camera |
| | | Zebra pattern | Camera |
| | | Wrinkle shape | Shape measuring instrument |

Furthermore, as illustrated in Table 4 below, the occurrence of a wrinkle can be inhibited by changing a forming load of a servo press machine, wrinkle pressing force and a wrinkle presser standby position of a servo die cushion, pressure of a movable die caused by a press forming die, a standby position, and the height of a distance block. Although a usual press machine can move a slide only by a preset stroke, the stroke can be changed in an in-line manner by using the servo press machine. The forming load is increased by further increasing a preset bottom dead point stroke by several millimeters. The occurrence of a wrinkle can be inhibited by crushing a generated wrinkle. Furthermore, the servo die cushion decreases the material inflow amount by increasing wrinkle pressing force in drawing or raising the wrinkle presser standby position, and thereby the occurrence of a wrinkle can be inhibited. Furthermore, a material outflow amount is increased by increasing the pressure of the movable die (pad) in the die or raising the standby position of the movable die, and thereby the occurrence of a wrinkle can be inhibited. Moreover, for example, the clearance between the die face and the wrinkle presser is partially decreased to have the sheet thickness or less by partially decreasing heights of the plurality of distance blocks provided in the die, which can decrease the material inflow amount. Thus, the occurrence of a wrinkle can be inhibited.

TABLE 4

| Control target | Control item | Expected effect to cracking inhibition |
|---|---|---|
| Servo press | Forming load | Wrinkle is inhibited by crushing generated wrinkle |
| | Run-in quantity | |
| | Wrinkle pressing pressure | Increasing decreases inflow amount, and wrinkle is inhibited |
| | Wrinkle presser standby position | Raising decreases inflow amount, and wrinkle is inhibited |
| Die | Pad pressure | Increasing decreases outflow amount, and wrinkle is inhibited |
| | Pad standby position | Lowering decreases outflow amount, and wrinkle is inhibited |
| | Distance block height | Decreasing decreases inflow amount, and wrinkle is inhibited |
| | Stroke end | |
| | Holder end | |
| | Pad end | |

[Fourth Embodiment]

In the fourth embodiment, the arithmetic device 122 determines the directionality of the press forming condition for inhibiting the occurrence of a dimensional accuracy defect of a press-formed component based on a prediction result of the press forming result. Furthermore, the arithmetic device 122 corrects the press forming condition in a direction of inhibiting the occurrence of the dimensional accuracy defect of a press-formed component by complementing the error of the predicted value of the press forming result based on a result of analyzing actual values of mass production press. Examples of a complementing method include a method using a complementing coefficient calculated by preliminarily and experimentally determining an error between a prediction result based on the CAE technology and an actual value and a method using a machine learning model for minimizing the above-described error. Then, the arithmetic device 122 stores data on material characteristics of the coil material C and a press forming result corresponding to the corrected press forming condition in the database 121.

Furthermore, the arithmetic device 122 performs statistical analysis by using data on a material characteristic value of the coil material C, a press forming condition, an actual press forming result, and the like. The arithmetic device 122 thereby analyzes the relation between the material characteristic value of the coil material C or the press forming condition and the press forming result, and stores an analysis result in the database 121. Furthermore, the arithmetic device 122 generates a machine learning model that uses, as input, the above-described input information and uses, as output, the press forming condition for inhibiting the occurrence of a dimensional accuracy defect of the press-formed component by a method such as artificial intelligence and machine learning using the data stored in the database 121. Furthermore, the arithmetic device 122 inputs input information to the machine learning model in response to a command to calculate the press forming condition for inhibiting the occurrence of the dimensional accuracy defect of a press-formed component to calculate a press forming condition for inhibiting the occurrence of the dimensional accuracy defect of a press-formed component corresponding to the input information. Examples of the calculated press forming condition include a forming load, forming motion, and wrinkle pressing force. Then, the control device 12 performs feedback control on at least one of the servo press machine 8 and a preprocessing device 14 provided on the downstream side of the blanking process under the calculated press forming condition.

Note that, in particular, mechanical characteristics of the coil material C such as yield strength (YS) and tensile strength (TS), the shape of a plate-shaped material, and an arrangement position to a forming die have strong influence on the occurrence of a dimensional accuracy defect. Therefore, the control device 12 calculates an appropriate press forming condition by measuring and analyzing fluctuations of a material characteristic value and a measured value before press forming, and inhibits the occurrence of a dimensional accuracy defect by feedforward type control. In the embodiment, the control device 12 estimates strength-related material characteristics such as yield strength and tensile strength by associating an actually measured value of material strength measured in an in-line manner with manufacturing information of the material by a method such as artificial intelligence and machine learning. As illustrated in Table 5 below, the information on material strength in this case can be measured by measuring a shear load at the time of blanking the material and measuring a residual magnetic field after applying a pulse magnetic field to the material before blanking. Furthermore, fluctuation in the shape of a plate-shaped material causes fluctuation in the dimensional accuracy of a press-formed component after press forming. In particular, a material having higher material strength greatly fluctuates due to a lack of pressurizing power of a plate-shaped correcting device. Therefore, it is preferred to measure the shape of the plate-shaped material with a shape measuring instrument such as a two-dimensional laser displacement meter before press forming. Furthermore, a change in the arrangement position of a material to a forming die causes a change in the balance of the shape of the press-formed component, so that the dimensional accuracy also fluctuates. Therefore, it is preferred to measure the arrangement position of the material with a laser displacement meter or the like.

In contrast, the occurrence of the dimensional accuracy defect of a press-formed component changes the shape of the press-formed component after press forming. Therefore, the control device 12 calculates an appropriate press forming condition by measuring fluctuation of a measured value and predicting and analyzing tendency of the measured value. The control device 12 inhibits the occurrence of a dimensional accuracy defect by feedback type control. An occurrence position of a dimensional accuracy defect and a deviation quantity can be measured by measuring the one-dimensional shape, two-dimensional shape, and three-dimensional shape with a displacement meter or a shape measuring instrument and comparing the shapes with the shape of a normal press-formed component at the time of conveyance or in an inspection process of a press-formed component after press forming.

TABLE 5

| Forming defect | Control type | Measurement target | Measurement method |
|---|---|---|---|
| Dimensional accuracy defect | F/F | YS, TS | Shear load<br>Residual magnetic field |
| | | Material plate shape | 2D laser displacement meter |
| | | Material placement position | Laser displacement meter |
| | F/B | Shape | Shape measuring instrument |

Furthermore, as illustrated in Table 6 below, the occurrence of a dimensional accuracy defect can be inhibited by changing a forming load and forming motion of a servo press machine, changing wrinkle pressing force and a wrinkle presser standby position of a servo die cushion, changing pressure of a movable die caused by a press forming die and a standby position, changing the height of a distance block, and changing an amount of cam bending caused by a cam mechanism, a position where a material is disposed at the time of conveyance, and the like. Furthermore, although a usual press machine can move a slide only by a preset stroke, the stroke can be changed in an in-line manner by using the servo press machine. Furthermore, further increase and decrease in a preset bottom dead point stroke by several millimeters causes an increase and a decrease in a forming load, which changes an elastic deformation amount of a forming die and a deformation amount of a formed component. Thus, the dimensional accuracy can be changed.

Furthermore, slide motion in usual press forming is crank motion by uniform circular motion. The shape balance of the press-formed component is changed by performing forming while reducing forming speed immediately before a forming bottom dead point or while stopping the slide motion a plurality of times in the middle of a bottom dead point stroke, and thereby the dimensional accuracy can be changed. Furthermore, the servo die cushion increases and decreases the material inflow amount by changing wrinkle pressing force in drawing or changing the wrinkle presser standby position, and the dimensional accuracy is changed by changing the shape balance of the press-formed component.

Furthermore, the shape balance of the press-formed component is similarly changed by changing the pressure of the movable die (pad) in the die or changing the standby position of the movable die, so that the dimensional accuracy is changed. Furthermore, for example, the clearance between the die face and the wrinkle presser can be partially changed by partially changing heights of the plurality of distance blocks provided in the die. Furthermore, the bottom dead point stroke can be changed. Thus, in any case, the shape balance of the press-formed component is changed, and the dimensional accuracy can be changed. Furthermore, an amount of bending of the press-formed component can be changed by adopting a cam bending structure using a cam mechanism as the die. Thus, the dimensional accuracy can be changed. Furthermore, if a placement position is changed at the time when a material is placed into a die in the next process at the time of conveyance, the balance of the shape of the press-formed component after press forming is changed. Thus, the dimensional accuracy can be changed.

TABLE 6

| Control target | Control item | Expected effect to dimensional accuracy defect |
|---|---|---|
| Servo press | Forming load<br>Run-in quantity | Dimensional accuracy is changed by change in die elastic deformation amount and forming amount |
| | Forming motion | Dimensional accuracy is changed by change in shape balance |
| | Wrinkle pressing pressure<br>Wrinkle presser standby position | Shape balance is changed by increase and decrease in inflow amount, and dimensional accuracy is changed |
| Die | Pad pressure<br>Pad standby position<br>Distance block height<br>Stroke end<br>Holder end<br>Pad end | Shape balance is changed by increase and decrease in inflow amount, and dimensional accuracy is changed |
| | Cam slider | Dimensional accuracy is changed by change in bending amount |
| Conveyance | Material setting position | Dimensional accuracy is changed by change in shape balance |

[Fifth Embodiment]

A arithmetic device 122 of a fifth embodiment is applied to the press line 1 in FIGS. 5 and 6. In the embodiment, the arithmetic device 122 determines the directionality of the press forming condition for inhibiting the occurrences of die damage and a surface quality defect of a press-formed component caused by the die damage based on a prediction result of the press forming result. Furthermore, the arithmetic device 122 corrects the press forming condition in a direction of inhibiting the occurrence of the die damage and the surface quality defect of a press-formed component caused by the die damage by complementing an error of the predicted value of the press forming result based on a result of analyzing actual values of mass production press. Examples of a complementing method include a method using a complementing coefficient calculated by preliminarily and experimentally determining an error between a prediction result based on the CAE technology and an actual value and a method using a machine learning model for minimizing the above-described error. Then, the arithmetic device 122 stores data on material characteristics of the coil material C and a press forming result corresponding to the corrected press forming condition in the database 121.

Furthermore, the arithmetic device 122 performs statistical analysis by using data on a material characteristic value of the coil material C, a press forming condition, an actual press forming result, and the like. The arithmetic device 122 thereby analyzes the relation between the material characteristic value of the coil material C or the press forming condition and the press forming result, and stores an analysis result in the database 121. Furthermore, the arithmetic device 122 generates a machine learning model that uses, as input, the above-described input information and uses, as output, the press forming condition for inhibiting the occurrence of the die damage and the surface quality defect of a press-formed component caused by the die damage by a method such as artificial intelligence and machine learning using the data stored in the database 121. Furthermore, the arithmetic device 122 inputs input information to the machine learning model in response to a command to calculate the press forming condition for inhibiting the occurrence of the die damage and the surface quality defect of a press-formed component caused by the die damage to calculate a press forming condition for inhibiting the occurrence of the die damage and the surface quality defect of a press-formed component caused by the die damage corresponding to the input information. Examples of the calculated press forming condition include a forming load, forming motion, and wrinkle pressing force. Then, the control device 12 performs feedback control on at least one of the servo press machine 8 and a preprocessing device 14 provided on the downstream side of the blanking process under the calculated press forming condition.

Note that the occurrence of the die damage and the surface quality defect of a press-formed component caused by the die damage changes measured values of an image, a forming load, vibration, temperature, and the like during or after press forming. Therefore, the control device 12 calculates an appropriate press forming condition by measuring fluctuation of a measured value and predicting and analyzing tendency of the measured value. The control device 12 inhibits the occurrence of the die damage and the surface quality defect of a press-formed component caused by the die damage by feedback type control. Specifically, as illustrated in Table 7 below, a change in the material inflow amount can be detected by capturing an image of a press-formed component after press forming with a camera and analyzing an image of a profile of an edge of the press-formed component after drawing. In mass production press forming, the occurrence of the die damage increases the frictional resistance of a die face to a material and that of a wrinkle presser to the material, which decreases the material inflow amount. Thus, the occurrence of the die damage can be indirectly detected. Furthermore, the surface quality defect caused by the die damage can be directly detected directly capturing an image of the press-formed component and analyzing the image including light and dark of the surface. Furthermore, a forming load during press forming can be measured by a load meter such as a load cell installed, for example, in a press machine main body, between a slide of the press machine and a die, and in the die. When the die damage occurs, noise appears in a usual waveform of a forming load. The occurrence of the die damage can thus be detected by measuring fluctuation of the forming load during press forming. Furthermore, vibration during press forming can be measured by acoustic emission (AE) and the like. When the die damage occurs, noise vibration that is not observed usually is detected. Thus, the die damage can be detected. Furthermore, temperature distribution on the surface of the die can be measured by measuring the temperature of the die during or after press forming by thermography or with a non-contact thermometer. Usually, surface coating treatment is performed on a forming die to prevent damage on the surface of the die. For example, surface coating includes a compound such as TiC and CrN, and has a heat resistant temperature as a characteristic of compounds. In mass production press forming, when a die stores heat and the press forming is continued with the temperature of the surface coating exceeding the heat resistant temperature, the surface coating is peeled off or the die is damaged. Therefore, the die damage can be indirectly detected by measuring the temperature of the die.

TABLE 7

| Forming defect | Control type | Measurement target | Measurement method |
|---|---|---|---|
| Die damage | F/B | Image<br>Forming load<br>Vibration<br>Temperature | Camera<br>Load cell<br>AE<br>Thermography<br>Non-contact thermometer |

Furthermore, as illustrated in Table 8 below, the occurrence of the die damage and the surface quality defect of a press-formed component caused by the die damage can be inhibited by changing forming motion of the servo press machine or applying oil to the coil material C using the preprocessing device 14 before press forming. Slide motion in usual press forming is crank motion by uniform circular motion. Damage at the time when the coil material C and the die come into contact with each other is reduced by performing press forming while reducing forming speed immediately before a forming bottom dead point or while stopping the slide motion a plurality of times in the middle of a bottom dead point stroke, and an amount of heat generated at the time of processing can be reduced. This can inhibit the occurrence of the die damage and the surface quality defect of a press-formed component caused by the die damage. Furthermore, in the preprocessing device, when oil is applied to the coil material C or the die with an oil spray before press forming, the lubricity between the coil material C and the die is improved, and heat generation at the time of processing can be inhibited. This can inhibit the occurrence of the die damage and the surface quality defect of a press-formed component caused by the die damage.

TABLE 8

| Control target | Control item | Expected effect to die damage |
|---|---|---|
| Servo press | Forming motion | Die damage is inhibited by reduction of damage at time when material and die come into contact with each other and reduction of heat generated at time of processing |
| Preprocessing device | Oil spray | Die damage is inhibited by improvement in lubricity between material and die and effect of cooling heat generated at time of processing |

Although the embodiments to which the invention made by the present inventors is applied have been described above, the present invention is not limited by the description and drawings constituting a part of the disclosure of the present invention according to the embodiments. That is, other embodiments, examples, operation techniques, and the like made by those skilled in the art and the like based on the embodiments are all included in the scope of the present invention.

INDUSTRIAL APPLICABILITY

According to aspects of the present invention, it is possible to provide a press line capable of inhibiting occurrence of a forming defect without requiring much labor and cost. Furthermore, according to aspects of the present invention, it is possible to provide a press forming condition calculation method and a press forming condition calculation program capable of calculating a press forming condition for inhibiting the occurrence of a forming defect. Furthermore, according to aspects of the present invention, it is possible to provide a press line capable of inhibiting occurrence of cracking of a metal material without requiring much labor and cost. Furthermore, according to aspects of the present invention, it is possible to provide a press forming condition calculation method and a press forming condition calculation program capable of calculating a press forming condition for inhibiting the occurrence of cracking of a metal material. Furthermore, according to aspects of the present invention, it is possible to provide a press line capable of inhibiting occurrence of a wrinkle of a metal material without requiring much labor and cost. Furthermore, according to aspects of the present invention, it is possible to provide a press forming condition calculation method and a press forming condition calculation program capable of calculating a press forming condition for inhibiting the occurrence of a wrinkle of a metal material. Furthermore, according to aspects of the present invention, it is possible to provide a press line capable of inhibiting occurrence of a dimensional accuracy defect of a press-formed component without requiring much labor and cost. Furthermore, according to aspects of the present invention, it possible to provide a press forming condition calculation method and a press forming condition calculation program capable of calculating a press forming condition for inhibiting the occurrence of a dimensional accuracy defect of a press-formed component. Furthermore, according to aspects of the present invention, it is possible to provide a press line capable of inhibiting occurrence of die damage and a surface quality defect of a press-formed component caused by the die damage without requiring much labor and cost. Furthermore, according to aspects of the present invention, it is possible to provide a press forming condition calculation method and a press forming condition calculation program capable of calculating a press forming condition for inhibiting the occurrence of the die damage and the surface quality defect of a press-formed component caused by the die damage.

REFERENCE SIGNS LIST

1, 100 PRESS LINE 2 PAY-OFF REEL 3 UNCOILER LEVELER 4 BLANKING DIE 5 CONVEYING DEVICE 6 FORMING DIE 7 MECHANICAL PRESS MACHINE 8 SERVO PRESS MACHINE 11 SENSOR 12, 12*a*, 12*b* CONTROL DEVICE 13 MATERIAL MANUFACTURING FACTORY 14 PREPROCESSING DEVICE 15 TRANSMISSION DEVICE 16 RECEPTION DEVICE 121 DATABASE 122 ARITHMETIC DEVICE C COIL MATERIAL P PRESS-FORMED COMPONENT

The invention claimed is:

1. A press line comprising:

a first press machine configured to shear an outer peripheral portion of a metal material by using a blanking die;

a second press machine configured to form a press-formed component by performing press forming on the metal material sheared by the first press machine with a forming die;

a preprocessing device provided on a downstream side of the first press machine and configured to perform predetermined preprocessing on the metal material;

a sensor configured to measure information on a material characteristic value of the metal material before the press forming; and a controller configured to calculate a press forming condition for inhibiting occurrence of a forming defect, die damage, and a surface quality defect of the press-formed component caused by the die damage for a metal material to be formed by inputting the material characteristic value of the metal material to be formed measured by the measurement instrument and manufacturing information of the metal material to a machine learning model that uses, as input, the material characteristic value of the metal material and the manufacturing information and uses, as output, a press forming condition of the metal material for inhibiting the occurrence of a forming defect, die damage, and a surface quality defect of the press-formed component caused by the die damage, and perform feedforward control on at least one of the second press machine and the preprocessing device under the calculated press forming condition, wherein the press forming condition includes forming load and forming motion.

2. A press forming condition calculation method comprising a step of calculating a press forming condition for inhibiting occurrence of a forming defect, die damage, and a surface quality defect of the press-formed component caused by the die damage for a metal material to be formed by inputting a material characteristic value of the metal material to be formed and manufacturing information to a machine learning model that uses, as input, the material characteristic value of the metal material and the manufacturing information and uses, as output, the press forming condition of the metal material for inhibiting the occurrence of a forming defect, die damage, and a surface quality defect of the press-formed component caused by the die damage, wherein the press forming condition includes forming load and forming motion.

3. A non-transitory computer-readable recording medium on which an executable program for calculating a press forming condition, the program causing a processor of a computer to execute calculating a press forming condition for inhibiting occurrence of a forming defect, die damage, and a surface quality defect of the press-formed component caused by the die damage for a metal material to be formed by inputting a material characteristic value of the metal material to be formed and manufacturing information to a machine learning model that uses, as input, the material characteristic value of the metal material and the manufacturing information and uses, as output, the press forming condition of the metal material for inhibiting the occurrence of a forming defect, die damage, and a surface quality defect of the press-formed component caused by the die damage, wherein the press forming condition includes forming load and forming motion.

* * * * *